US011145229B1

(12) United States Patent
Haddad

(10) Patent No.: US 11,145,229 B1
(45) Date of Patent: Oct. 12, 2021

(54) ILLUMINATED SIGN APPARATUS WITH A HUE INSERT

(71) Applicant: Salim D. Haddad, Troy, MI (US)

(72) Inventor: Salim D. Haddad, Troy, MI (US)

( * ) Notice: Subject to any disclaimer, the term of this patent is extended or adjusted under 35 U.S.C. 154(b) by 0 days.

(21) Appl. No.: 17/187,347

(22) Filed: Feb. 26, 2021

(51) Int. Cl.
*G09F 13/04* (2006.01)

(52) U.S. Cl.
CPC ..... *G09F 13/0404* (2013.01); *G09F 13/0445* (2021.05); *G09F 13/0454* (2021.05)

(58) Field of Classification Search
CPC ..... G09F 13/0404; G09F 13/0454; G09F 13/0445
See application file for complete search history.

(56) References Cited

U.S. PATENT DOCUMENTS 3,309,806 A 3/1967 Gallagher
4,970,816 A 11/1990 Trame
6,594,931 B1 7/2003 Barton et al.
7,467,486 B2 12/2008 Kaoh
8,375,613 B2 2/2013 Spiro
8,984,780 B2 3/2015 Brassell et al.
9,837,000 B2 12/2017 Haddad
2004/0004827 A1 1/2004 Guest
2004/0212998 A1* 10/2004 Mohacsi ..... G09F 13/0404 362/294
2007/0240346 A1* 10/2007 Li ..... G09F 13/22 40/544
2014/0347877 A1* 11/2014 Zharov ..... B60Q 1/50 362/559
2017/0287370 A1* 10/2017 Haddad ..... G09F 13/08

* cited by examiner

*Primary Examiner* — Gary C Hoge
(74) *Attorney, Agent, or Firm* — Burris Law, PLLC

(57) ABSTRACT

A sign apparatus includes a front panel and a rear panel secured to the front panel. The rear panel includes a back portion, a side portion, and a rim. The side portion has an illumination panel step disposed between the back portion and the rim and the illumination panel step is configured to support a hue insert to modify one or more visible characteristics of light emitted by a light source. A cavity is defined between the rear panel and the front panel, and the hue insert is disposed within the cavity.

20 Claims, 3 Drawing Sheets

ILLUMINATED SIGN APPARATUS WITH A HUE INSERT

FIELD

The present disclosure relates to illuminated signs. More particularly, the present disclosure relates to signage having multiple panels.

BACKGROUND

The statements in this section merely provide background information related to the present disclosure and may not constitute prior art.

It is common practice for organizations, such as banks, restaurants, and educational institutions, to have an illuminated sign mounted outside or inside of their facility. Such signs are typically designed to identify and attract consumers and/or clients to the organization.

Generally, an illuminated sign apparatus can include one or more light sources for illuminating the front face of the sign, and for also creating a glowing halo around the sign. While the illumination allows a viewer to see the sign from a distance, light from the different illuminated regions may blend causing the sign apparatus to appear dull and unclear, and thus, diminishing the brightness and clarity of the sign apparatus. This and other issues related to the performance and characteristics of a sign apparatus are addressed by the present disclosure.

SUMMARY

This section provides a general summary of the disclosure, and is not a comprehensive disclosure of its full scope or all of its features.

In one form, the present disclosure is directed toward a sign apparatus that includes a front panel, a rear panel, and a cavity defined between the rear panel and the front panel and a hue insert. The front panel has a front portion and a side portion. The rear panel is secured to the front panel and has a back portion and a side portion. The side portion has an illumination panel step disposed between the back portion and the front panel. The illumination panel step is configured to support a hue insert configured to modify one or more visible characteristics of light emitted by a light source.

In one variation, the side portion of the rear panel has a front panel step that is opposed to the side portion of the front panel with the rear panel secured to the front panel.

In another variation, the illumination panel step is provided between the front panel step and the back portion.

In yet another variation, the side portion of the rear panel includes a plurality of the illumination panel steps provided between the back portion and the front panel.

In one variation, the side portion of the front panel is arranged between the cavity and the side portion of the rear panel.

In another variation, the visible characteristics includes a shade, a color, or combination thereof of the light being emitted.

In yet another variation, the sign apparatus further includes a fastener that secures the front panel with the rear panel. The fastener extends through the side portions of the rear panel and the front panel.

In one variation, the back portion of the rear panel is transparent.

In another variation, the back portion of the rear panel has translucent properties.

In yet another variation, the side portion of the rear panel further includes a rim that is configured to have opaque properties.

In one variation, the front portion is configured to have translucent properties to pass light emitted from the light source.

In one form, the present disclosure is directed toward a sign apparatus that includes a light source operable to emit light, a front panel having a front portion and a side portion, a rear panel secured to the front panel, a cavity defined between the rear panel and the front panel, and a hue insert. The rear panel has a back portion and a side portion. The side portion has an illumination panel step disposed between back portion and the front panel. The hue insert is disposed within the cavity and configured to modify one or more visible characteristics of the light emitted by the light source. The illumination panel step is configured to support the hue insert.

In one variation, the side portion of the rear panel has a front panel step that is opposed to the side portion of the front panel.

In another variation, the illumination panel step is provided between the front panel step and the back portion.

In yet another variation, the side portion of the rear panel includes a plurality of the illumination panel steps provided between the back portion and the front panel.

In one variation, the side portion of the front panel is arranged between the cavity and the side portion of the rear panel.

In another variation, the visible characteristics includes a shade, a color, or combination thereof of the light being emitted.

In one form, the present disclosure is directed to a sign apparatus that includes a light source operable to emit light, a front panel having a front portion and a side portion, a rear panel secured to the front panel, a cavity defined between the rear panel and the front panel, and a hue insert. The front portion of the front panel is configured to have translucent properties to pass light emitted from the light source. The rear panel has a back portion, a side portion, and a rim. The side portion has an illumination panel step and a front panel step. The illumination panel step is disposed between back portion and the rim and the front panel step is opposed to the side portion of the front panel. The hue insert is disposed within the cavity and configured to modify one or more visible characteristics of the light emitted by the light source. The illumination panel step is configured to support the hue insert. The visible characteristics includes a shade, a color, or combination thereof of the light being emitted.

In one variation, the illumination panel step is provided between the front panel step and the back portion.

In another variation, the side portion of the rear panel includes a plurality of the illumination panel steps provided between the back portion and the rim.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected forms and not all possible implementations, and are not intended to limit the scope of the present disclosure.

Corresponding reference numerals indicate corresponding parts throughout the several views of the drawings.

DETAILED DESCRIPTION

Figure 1:
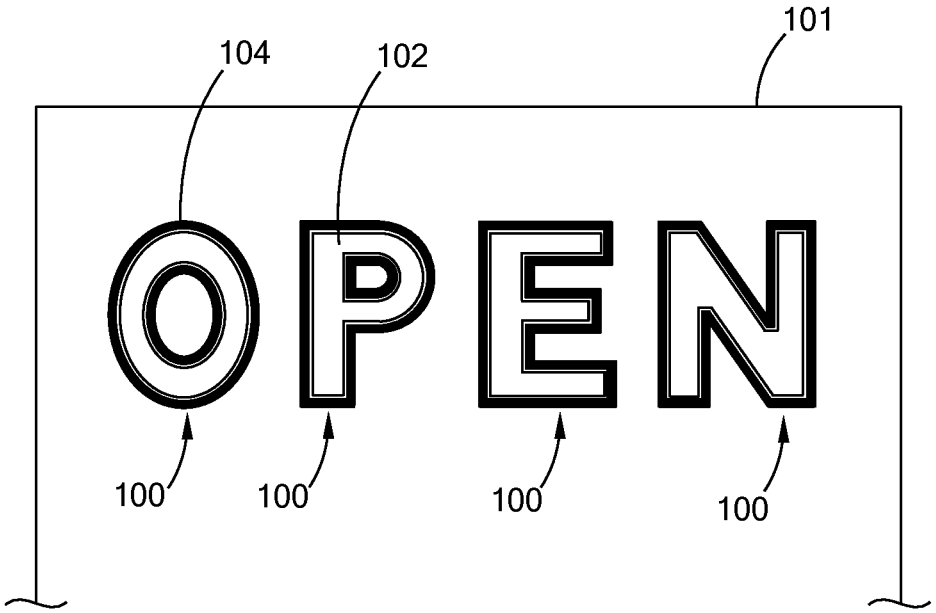
FIG. 1 is a perspective view of a sign apparatus in a first form in accordance with the present disclosure.

The following description is merely exemplary in nature and is not intended to limit the present disclosure, application, or uses. It should be understood that throughout the drawings, corresponding reference numerals indicate like or corresponding parts and features.

To adjust the visible characteristics of a sign apparatus, the present disclosure provides for an illuminated sign apparatus having an illumination panel step and a hue insert supported by the illumination panel step. In one form, the hue insert is configured to adjust, for example, a shade, a color, or a combination thereof of the sign apparatus. In addition, the sign apparatus is configured to be modular to interchange hue inserts while inhibiting unwanted physical alteration of the sign apparatus. Accordingly, among other benefits, the sign apparatus of the present disclosure enhances the visible characteristics of the sign apparatus based on the desires of the user.

Referring to FIG. 1, a sign apparatus 100 is mounted on a wall 101, and made of characters and/or symbols for conveying information. The sign apparatus 100 of the present disclosure may be designed to convey various information and is not limited to the logo depicted in the figures.

The sign apparatus 100 includes a front panel 102 and a rear panel 104, which are collectively referred to as panels 102 and 104. The front panel 102 is a front face of the sign apparatus 100, and the rear panel 104 is positioned behind the front panel 102. The panels 102 and 104 may be made of plastic and formed using, for example, thermoforming in which a plastic sheet is heated to a pliable forming temperature and formed to a specific shape in a mold. The plastic sheet may be configured in various suitable colors and transparency. For example, a clear/transparent plastic sheet may be formed with a color film disposed thereon to create a colored plastic panel. Alternatively, a colored plastic sheet may be used to create the panel. Other suitable plastic forming processes may also be used to construct the panels 102 and 104.

Figure 2:
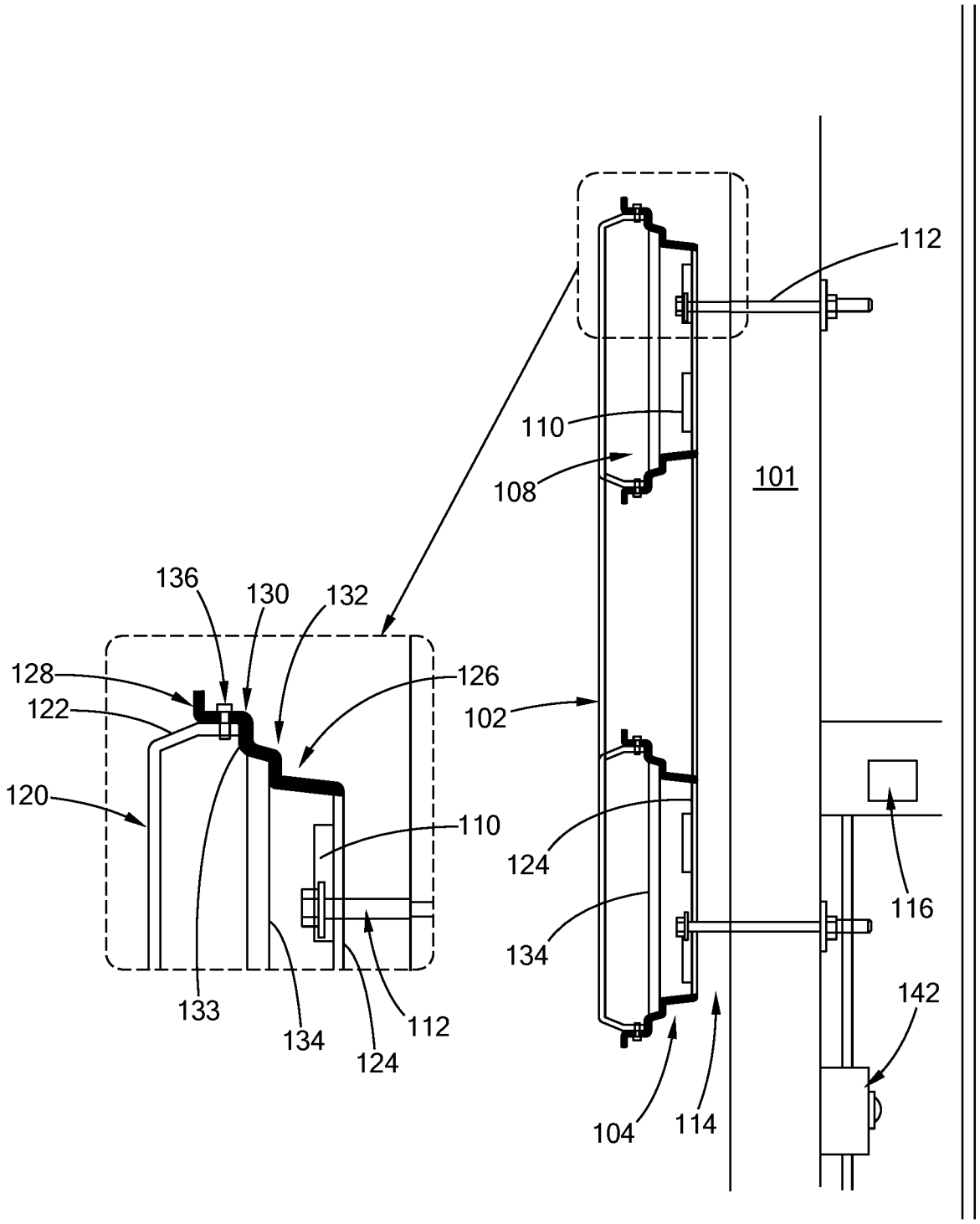
FIG. 2 is a partial cross-sectional view of the sign apparatus of FIG. 1.

Referring to FIG. 2, the front panel 102 and the rear panel 104 define a cavity 108 in which one or more light sources 110 are disposed. In one form, the sign apparatus 100 is mounted to the wall 101 by way of one or more fasteners 112. The sign apparatus 100 may be positioned away from the wall 101 such that a gap 114 is provided between the rear panel 104 and the wall 101.

The light sources 110 may be light emitting diodes (LEDs) that are arranged within the cavity 108 and operable to emit light. The sign apparatus 100 may include an electrical box 116 that is electrically coupled to a power supply 142, such as an electrical outlet. The electrical box 116 may include a switch (not shown) and other electrical components for supplying power to the light sources 110. The electrical box 116 may be configured in various suitable ways for supplying power to the light source 110. For example, the electrical box 116 may include a main switch that is manually operable by a user for turning the light sources 110 ON/OFF. Alternatively, in lieu of or in addition to the switch, the electrical box 116 may include a processor that is programed to turn the light sources 110 ON/OFF at preset times.

The front panel 102 includes a front portion 120 and a side portion 122 that extends away from the front portion 120 toward the rear panel 104. In one form, the front portion 120 has translucent properties for transmitting and/or diffusing light emitted by the light sources 110. The side portion 122 may be configured in a similar manner as the front portion 120, and therefore, may also have translucent properties and/or be the same color. Alternatively, the side portion 122 may be configured differently, such as being a different color and/or being opaque to reflect and/or absorb the light emitted. The side portion 122 may be referred to as a front side portion 122 in the following.

The rear panel 104 includes a back portion 124, a side portion 126, and a rim 128. The back portion 124 may be translucent for transmitting and/or diffusing light emitted by the light sources 110 and may be, for example, transparent or have a color film that has light transmitting properties. The light sources 110 may be positioned and attached along the back portion 124 of the rear panel 104, and the fastener 112 may extend through the back portion 124 to attach the sign apparatus 100 to the wall 101.

The rim 128 extends from the rear side portion 126 toward a direction opposite of the cavity 108. The rim 128 is configured to follow the contour of the front panel 102 and extend beyond a periphery of the front panel 102, thus forming a border around the front panel 102. In one form, the rim 128 has opaque properties to absorb and/or reflect light from the light source. Accordingly, the rim 128 provides a defined outline along the contour of the sign apparatus 100.

In one form, the side portion 126 includes a front panel step 130 and an illumination panel step 132 that are provided between the back portion 124 and the rim 128. The side portion 126 may be opaque to absorb and/or reflect light from the light source. The side portion 126 may also be referred to as a rear side portion 126. In one form, the front panel step 130 is configured to be opposed to the front side portion 122 and more particularly, to a distal end 133 of the front side portion 122. That is, the front panel step 130 is provided as a positional stop for the front panel 102. In one form, with the front panel 102 secured to the rear panel 104, the front side portion 122 is between the cavity 108 and the rear side portion 126. More particularly, sections of the front side portion 122 and the rear side portion 126 extend parallel with each other between the rim 128 and the front panel step 130.

The illumination panel step 132 is provided between the front panel step 130 and the back portion 124. The illumination panel step 132 is configured to support a hue insert 134. More particularly, in one form, the illumination panel step 132 extends within the cavity 108 following a contour of a respective character of the sign apparatus 100 and forms a ledge to support the hue insert 134.

The hue insert 134 is configured to modify one or more visible characteristics of light emitted by the light source 110. The visible characteristics includes a shade, a color, or combination thereof of the light being emitted (i.e., illumination of the sign apparatus 100). More particularly, in one form, the hue insert 134 is a planar component (e.g., a flat plastic component) the is substantially the same shape/contour of a respective character of the sign apparatus 100. For example, the sign apparatus 100 may include hue inserts shaped for each of the letters "O", "P", "E", and "N". The hue inserts 134 can be of a specific color, have a desired translucent property, or a combination thereof to modify the visible characteristics of the sign apparatus 100. For example, if the front portion 120 of the front panel 102 is green, the hue insert 134 may be provided as green to enhance the green hue of the sign apparatus. In another example, the hue insert 134 is a colorless frosted component that modifies the shade/tint of the green hue of the sign apparatus 100. It should be readily understood that the hue insert 134 may be configured in various suitable ways and is not limited to the example provided herein.

The front panel 102 and the rear panel 104 are secured to each other by way of one or more fasteners 136. In one form, the fasteners 136 are provided between the front panel step 130 and the rim 128 and extend through the rear side portion 126 and the front side portion 122. The fasteners 136 may be provided behind the rim 128 and thus, may not be visible to a viewer when the sign apparatus 100 is viewed in a direction toward the front panel 102. The interface between the front panel 102 and the rear panel 104 may be weatherproofed by a seal to prevent water and/or other debris from entering the cavity 108. For example, a neoprene seal may be provided between the front panel step 130 and the front side portion 122 of the front panel 102. In one form, the panels 102 and 104 are secured using removable fasteners 136 (e.g., screws, bolts) to allow access to components within the cavity 108, such as the light source 110 and the hue insert 134 and thus, provide a modular configuration.

In one example application in which the back portion 124 has translucent properties and with the light sources 110 emitting light, the front panel 102 and the wall 101 are illuminated and a contrasting unilluminated region is disposed therebetween. Specifically, light incident on the translucent portions of the front panel 102 generates a glow or, in other words, illuminates the front panel 102 and light incident on the back portion 124 of the rear panel 104 illuminates the wall 101 to form a halo or, in other words, a glow around the sign apparatus 100. The contrasting unilluminated region may be formed by the rear side portion 126 and the rim 128, which are opaque and thus, reflect or absorb light. The hue insert(s) 134 provided between the front panel 102 and the lighting source 110 modify the visible characteristics of the illumination by, for example, enhancing the color of the sign apparatus 100, sharpening/softening the illumination, or a combination thereof. With attached-detachable fasteners securing the front panel and the rear panel, the hue inserts 134 may be added or removed based on the environment and desired illumination, thus providing an adjustable and modular illumination apparatus.

Figure 3:
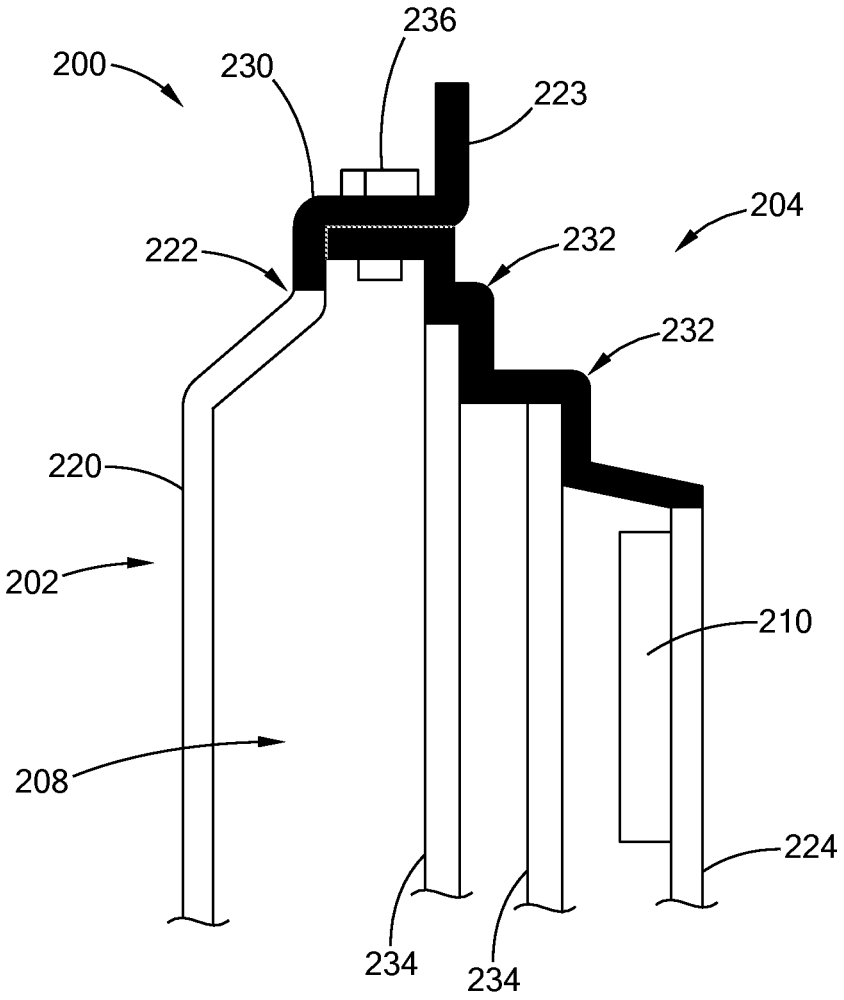
FIG. 3 is a second form of a sign apparatus in accordance with the present disclosure.

While the rear panel 104 includes one illumination step, the panel may include more than one illumination steps for one or more hue inserts. In addition, while the rim is provided at the rear panel, a rim may be formed with the front panel. For example, referring to FIG. 3, a sign apparatus 200 includes a front panel 202, a rear panel 204, a cavity 208 defined between the panels 202 and 204, and a light source(s) 210 disposed in the cavity. Like the front panel 102, the front panel 202 includes a front portion 220 and a side portion 222 that extends away from the front portion 220. In this example, the front panel 202 also includes a rim 223 extending outwardly from the side portion 222.

The rear panel 204 includes a back portion 224 and a side portion 226 having a boundary member 230 and a plurality of illumination panel steps 232 provided between the back portion 224 and the boundary member 230 of the side portion 226. In this example, a plurality of hue inserts 234 are provided for each of the illumination panel steps 232, however, one or more hue inserts 234 may be used even though multiple illumination panel steps 232 are provided.

The sign apparatus 200 provides a different panel securing configuration of the front panel 202 and rear panel 204. Specifically, in this application, the boundary member 230 is provided between the cavity 208 and the side portion 222 of the front panel 202. A fastener 236 secures the panels 202 and 204 through the side portion 222 and the boundary member 230.

It should be readily understood that multi illumination panel steps of the sign apparatus 200 may also be employed with the sign apparatus 100. In addition, the panel securing configuration of the sign apparatus 200 may be employed with single illumination panel step of the sign apparatus 100.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A sign apparatus comprising:

a front panel having a front portion and a side portion;

a rear panel secured to the front panel at an interface and including a back portion and a side portion, wherein the side portion has an illumination panel step disposed between the back portion and the front panel and spaced apart from the interface, the illumination panel step configured to support a hue insert configured to modify one or more visible characteristics of light emitted by a light source; and a cavity defined between the rear panel and the front panel, wherein the hue insert is disposed within the cavity.

2. The sign apparatus of claim 1, wherein the side portion of the rear panel has a front panel step that is opposed to the side portion of the front panel with the rear panel secured to the front panel.

3. The sign apparatus of claim 2, wherein the illumination panel step is provided between the front panel step and the back portion.

4. The sign apparatus of claim 1, wherein the side portion of the rear panel includes a plurality of the illumination panel steps provided between the back portion and the front panel.

5. The sign apparatus of claim 1, wherein the side portion of the front panel is arranged between the cavity and the side portion of the rear panel.

6. The sign apparatus of claim 1, wherein the visible characteristics includes a shade, a color, or combination thereof of the light being emitted.

7. The sign apparatus of claim 1 further comprising a fastener securing the front panel with the rear panel, wherein the fastener extends through the side portions of the rear panel and the front panel.

8. The sign apparatus of claim 1, wherein the back portion of the rear panel is transparent.

9. The sign apparatus of claim 1, wherein the back portion of the rear panel has translucent properties.

10. The sign apparatus of claim 1, wherein the side portion of the rear panel further includes a rim that is configured to have opaque properties.

11. The sign apparatus of claim 1, wherein the front portion is configured to have translucent properties to pass light emitted from the light source.

12. A sign apparatus comprising:

a light source operable to emit light;

a front panel having a front portion and a side portion;

a rear panel secured to the front panel at an interface and having a back portion and a side portion, wherein the side portion has an illumination panel step disposed between back portion and the front panel and spaced apart from the interface;

a cavity defined between the rear panel and the front panel; and a hue insert disposed within the cavity and configured to modify one or more visible characteristics of the light emitted by the light source, wherein the illumination panel step is configured to support the hue insert.

13. The sign apparatus of claim 12, wherein the side portion of the rear panel has a front panel step that is opposed to the side portion of the front panel.

14. The sign apparatus of claim 13, wherein the illumination panel step is provided between the front panel step and the back portion.

15. The sign apparatus of claim 12, wherein the side portion of the rear panel includes a plurality of the illumination panel steps provided between the back portion and the front panel.

16. The sign apparatus of claim 12, wherein the side portion of the front panel is arranged between the cavity and the side portion of the rear panel.

17. The sign apparatus of claim 12, wherein the visible characteristics includes a shade, a color, or combination thereof of the light being emitted.

18. A sign apparatus comprising:

a light source operable to emit light;

a front panel having a front portion and a side portion, wherein the front portion is configured to have translucent properties to pass light emitted from the light source;

a rear panel secured to the front panel at an interface and having a back portion, a side portion, and a rim, wherein the side portion has an illumination panel step and a front panel step, the illumination panel step is disposed between back portion and the front panel and spaced apart from the interface, and the front panel step is opposed to the side portion of the front panel;

a cavity defined between the rear panel and the front panel; and a hue insert disposed within the cavity and configured to modify one or more visible characteristics of the light emitted by the light source, wherein the illumination panel step is configured to support the hue insert, wherein the visible characteristics includes a shade, a color, or combination thereof of the light being emitted.

19. The sign apparatus of claim 18, wherein the illumination panel step is provided between the front panel step and the back portion.

20. The sign apparatus of claim 18, wherein the side portion of the rear panel includes a plurality of the illumination panel steps provided between the back portion and the rim.

* * * * *